US009797096B2

(12) United States Patent
Olkkonen et al.

(10) Patent No.: US 9,797,096 B2
(45) Date of Patent: Oct. 24, 2017

(54) FOOD WRAP PAPER AND METHOD OF MANUFACTURING SAME

(71) Applicant: MONDI AG, Vienna (AT)

(72) Inventors: Tiina Olkkonen, Helsinki (FI); Eerika Hoikkala, Lohja (FI); Tuomas Leppänen, Helsinki (FI)

(73) Assignee: MONDI AG, Vienna (AT)

( * ) Notice: Subject to any disclaimer, the term of this patent is extended or adjusted under 35 U.S.C. 154(b) by 0 days.

(21) Appl. No.: 14/915,842

(22) PCT Filed: Sep. 5, 2013

(86) PCT No.: PCT/EP2013/068347

§ 371 (c)(1),
(2) Date: Mar. 1, 2016

(87) PCT Pub. No.: WO2015/032432

PCT Pub. Date: Mar. 12, 2015

(65) Prior Publication Data

US 2016/0194831 A1 Jul. 7, 2016

(51) Int. Cl.

| | |
|---|---|
| ***D21H 27/10*** | (2006.01) |
| ***D21H 25/00*** | (2006.01) |
| ***D21H 19/10*** | (2006.01) |
| ***D21H 19/16*** | (2006.01) |
| ***D21H 21/36*** | (2006.01) |
| ***D21H 19/22*** | (2006.01) |
| ***D21H 19/34*** | (2006.01) |
| ***D21H 21/16*** | (2006.01) |
| ***D21H 23/24*** | (2006.01) |

(52) U.S. Cl.

CPC ..... *D21H 27/10* (2013.01); *D21H 19/10* (2013.01); *D21H 19/16* (2013.01); *D21H 19/22* (2013.01); *D21H 19/34* (2013.01); *D21H 21/16* (2013.01); *D21H 21/36* (2013.01); *D21H 23/24* (2013.01); *D21H 25/005* (2013.01)

(58) Field of Classification Search

None

See application file for complete search history.

(56) References Cited

U.S. PATENT DOCUMENTS

| | | | |
|---|---|---|---|
| 6,531,196 | B1 | 3/2003 | Aho et al. |
| 2007/0000568 | A1 | 1/2007 | Bohme et al. |

OTHER PUBLICATIONS

International Search Report for PCT/EP2013/068347 dated Apr. 24, 2014.

*Primary Examiner* — Mark Halpern

(74) *Attorney, Agent, or Firm* — B. Aaron Schulman, Esq.; Stites & Harbison, PLLC

(57) ABSTRACT

A method and apparatus for manufacturing food wrap paper. A paper web is formed and its first side is subjected to on-line surface treating by applying barrier material such that a water vapor and grease resistant barrier coating is formed onto the paper web. The forming and on-line surface treating are made so that after the on-line surface treating, the paper web has basis weight of 25.5 g/m$^2$ to 34 g/m$^2$ when measured in balance moisture.

30 Claims, 2 Drawing Sheets

FOOD WRAP PAPER AND METHOD OF MANUFACTURING SAME

This application is a 371 of PCT/EP2013/068347 filed 5 Sep. 2013.

TECHNICAL FIELD

The present invention generally relates to a method and apparatus of manufacturing food wrap paper. Particularly, though not exclusively, the present invention relates to a method and apparatus of manufacturing fast food wrap paper with basis weight of 25.5 g/m$^2$ to 34 g/m$^2$.

BACKGROUND ART

Fast food is often wrapped in relatively thin paper that is coated so as to mitigate penetration of grease into the structure of the paper and excessive passing through of vapour so as to mitigate loss of opacity and cooling of hot food. Such a wrap paper is typically produced in three major stages. First, a base paper is produced to have a fair opacity. To this end, $TiO_2$ particles are mixed to the pulp. Second, in an off-line process, one side of the base paper is waxed or polyethylene coated. Third, the paper is cut into sheets and packaged into boxes that are suited for end-user's needs.

The coating is made by applying heated wax or polyethylene in an off-line coating station onto a running paper web. The hot coating is in a molten form and thus adheres uniformly to the base paper and forms a barrier layer. The coating layer is relatively thin and light in comparison to the base paper being coated and thus in part cools down by itself to solid state as heat transfers from the coating to the base paper. When the coating is in the solid state, the coated paper is ready to be rolled in or cut into sheets and boxed.

Food wrap papers are produced with different specifications for different needs: hamburger wrap paper, for instance, is typically made of paper having basis weight of 25 g/m$^2$ to 33 g/m$^2$ including a few g/m$^2$ coating. French fries, on the other hand, are typically produced with significantly heavier base paper. Generally, the lighter the base paper, the more prone the paper is for web breaks, holes, wrinkles and other quality defects.

In papermaking, the capacity of paper production lines is constantly being increased as far as possible in order to reduce unit costs and thus to enhance efficiency of the production. The capacity can be effected in a number of ways, such as: increasing production rates (e.g. broader web, faster run speed), reducing down-time (faster grade changes, less web breaks, faster resumption of production after web-breaks) and reducing proportion of production that falls below quality requirements. Paper machines are notoriously expensive production units with which risks are not willingly taken if not absolutely necessary. For example, with the light-weight base paper for hamburger wrap, on-line coating is instantly un-attractive to a skilled person: the paper web is weak and prone for breaking especially when wetted by coating. The off-line coating wax and polyethylene are not suited for on-line coating. In on-line production they would form sticky deposits that accrue and kind of burn onto drying cylinders and rolls. Such stains may ultimately require grinding of cylinders or rolls.

It is an object of the invention to enhance the efficiency of the production of food wrap paper with basis weight of 25.5 g/m$^2$ to 34 g/m$^2$. Another object of the invention is to additionally or alternatively reduce the amount of additives and/or energy needed for production of such food wrap paper. Yet another object of the invention is to additionally or alternatively reduce defects in such food wrap paper.

SUMMARY

According to a first example aspect of the invention there is provided a method for manufacturing food wrap paper, comprising:

forming a paper web; and on-line surface treating a first side of the paper web by applying barrier material so as to inhibit penetration of water vapour, water, grease and oily substances to the paper web;

wherein the forming and on-line surface treating are made so that after the on-line surface treating, the paper web has basis weight of 25.5 g/m$^2$ to 34 g/m$^2$ when measured in balance moisture.

According to a second example aspect of the invention there is provided a paper making apparatus, comprising:

a forming section configured to form a paper web; and on-line surface treating system configured to surface treat a first side of the paper web by applying barrier material so as to inhibit penetration of water vapour, water, grease and oily substances to the paper web;

wherein the forming section and the on-line surface treating system are configured so that after the on-line surface treating, the paper web has basis weight of 25.5 g/m$^2$ to 34 g/m$^2$ when measured in balance moisture.

Different non-binding example aspects and embodiments of the present invention will be presented in following detailed description and in appended dependent claims. It should be appreciated that corresponding embodiments may be freely applied to other embodiments and example aspects.

BRIEF DESCRIPTION OF THE DRAWINGS

Some example embodiments of the invention will be described with reference to the accompanying drawings, in which.

DETAILED DESCRIPTION

In the following description, like reference signs denote like elements.

Figure 1:
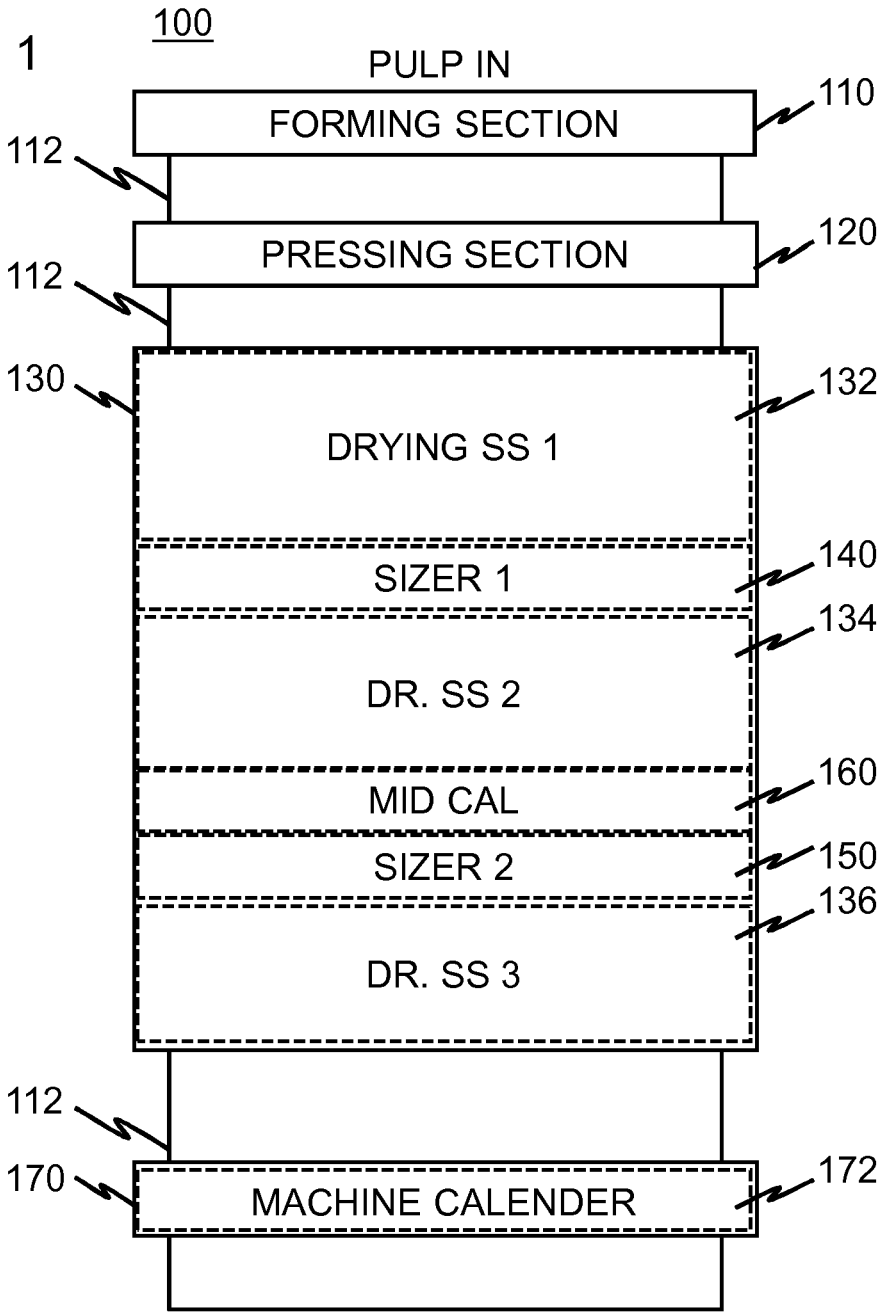
FIG. 1 shows a schematic picture of some basic elements of a paper machine according to an embodiment of the invention.

FIG. 1 shows a schematic picture of some basic elements of a paper machine 100 according to an embodiment of the invention. The paper machine 110 comprises a forming section 110 that receives pulp and forms a paper web 112. The paper web has a first side 112*a* and a second side 112*b*. In this example, the first side 112*a* is referred to as a functional side. Notice that the first side need not be on top as shown in FIG. 1 for illustration purpose only.

The paper machine 100 further comprises a pressing section 120 and a drying section 130 that remove water from paper web 112. The drying section is divided into two or more sub-sections 132, 134, 136 surrounding one or more paper treatment units such as surface treatment stations 140, 150 and middle calender 160. The paper machine 110 also comprises a finishing section 170. The finishing section 170 comprises, in this example, a machine calendar 172.

It is to be understood that each of the described sections are on-line units. In other words, these units operate on paper while it is being formed in the paper machine, or the paper is not transferred on a machine roll or winder roll, for example, to off-line processing.

The forming section 110 is implemented using commercially available parts such as headbox, foils, plastic or metallic wires and suction boxes. The forming section may aim at producing symmetric z-distribution of particles e.g. with a gap former or asymmetric z-distribution of particles e.g. using a fourdrinier wire. The forming section 110 as well as other main parts of the paper machine are configured using ordinary paper making knowledge considering the paper grade in question and available resources. The paper web is formed according to an example embodiment substantially without added opacifying chemicals. Substantially without added opacifying chemicals means in this context that opacifying chemicals are not intentionally added. Some opacifying chemicals may yet end up into the paper web from the source materials.

The drying section 130 typically comprises a number of steam-heated drying cylinders. A typical paper machine has some tens of drying cylinders, one or more of which may be of so-called Yankee cylinder type for also glazing the side of the paper web that contacts with the cylinder. The drying section 130 can also comprise infrared, air blow boxes, or any other elements. For control of cross-direction moisture profile of the paper web 112, the drying section 130 may also comprise a cross-directionally profiling moistening device.

In the example embodiment illustrated by FIG. 1, two sizing or coating stations 140, 150 are contained within the drying section and labelled as sizers that produce respective first and second layers onto a same side of the paper web 112. These sizers functionally split the drying section 130 into three sub-sections, i.e. first to third subsections denoted by reference signs 132, 134 and 136, respectively.

The paper machine 100 also comprises in one example embodiment one or more machine calendars before one or more sizing or coating stations.

In this document, sizing and coating may be used interchangeably unless expressly otherwise stated, as the difference is often somewhat indefinite.

The drying section 130 may be entirely within a single hood. Alternatively, the drying section 130 may be formed of physically more distinct sections distributed into two or more hoods.

A skilled paper maker knows how to implement the normal parts of a paper machine that operate as known in the art. Hence, the structure and operation relating to surface treating of the paper web 112 will next be described in further detail. The example embodiment shown in FIG. 1 is used for illustrating some implementations.

The machine calendar can be configured to flatten the paper web to target thickness or caliber. The target thickness is selected in some example embodiments from: a range of 30 μm to 38 μm; a range of 33 μm to 35 μm; and 34 μm. In thickness of 33 μm to 35 μm, preferably, 34 μm, the food wrap paper produced by the method may be perceived best suited for wrapping fast food such as hamburgers: dead-fold stiffness high enough to stay wrapped while still sufficiently thin to enable convenient wrapping also when wrapped multiple rounds around an object to be packaged. The calendering may help in packaging desired number of sheets in boxes of a predetermined size. Moreover, the calendering can be used to enable forming heavier and stronger base paper for barrier coating while achieving the target thickness.

Figure 2:
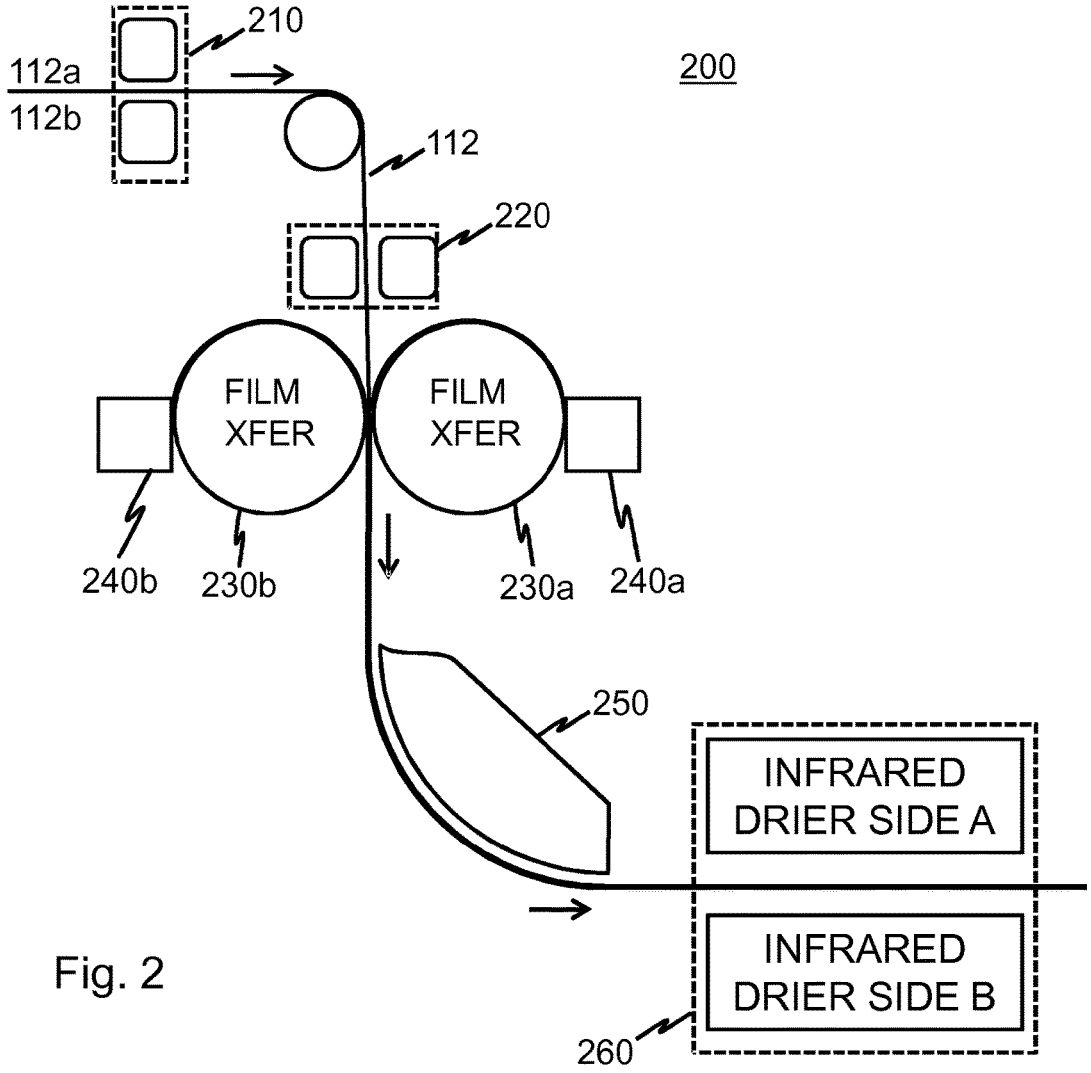
FIG. 2 shows a block diagram of a surface treatment station according to an embodiment of the invention.

FIG. 2 shows a block diagram of a system 200 that illustrates various example embodiments of the invention for treatment of the first side 112*a* and/or the second side 112*b* of the paper web 112. In comparison to FIG. 1, the system 200 may implement the first surface treatment station 140 and at least a portion of the second drying sub-section 134. The system 200 may alternatively or additionally be used as the second surface treatment station 150.

In FIG. 2, the paper web 112 is traveling from left to right hand direction. FIG. 2 shows a first unit 210 that is e.g. a measurement or profiling station. The first unit 210 can be e.g. a profiling moistening device and/or a profiling drying device.

A second unit 220 is provided, for instance, as a moisture measurement or moisture profiling station or as an applicator roll, curtain, short-dwell, air-doctor, size press or spray coating or sizing unit for applying coating or sizing material directly onto the paper web 112.

Alternatively or additionally to sizing or coating at the second unit 220, the system 200 can be configured to apply a film transfer layer on one or two nip rolls 230*a*, 230*b* with respective sizing or coating material application adjusters 240*a*, 240*b*. The sizing or coating material application adjusters 240*a*, 240*b* may comprise one or more jets, nozzles or mouths for output of the sizing or coating material and one or more amount limiters such as rods, blades, dosing rolls (as known from multi-roll sizers or coaters), and/or air-doctors for instance.

The surface treatment material and application amounts may differ between the different sides 112*a*, 112*b*. It is not even necessary in all embodiments to perform any surface treatment on both sides 112*a* and 112*b* of the paper web 112.

The first side 112*a* can be surface treated with a barrier material while the second side 112*b* can be left untreated. The barrier material is selected in some example embodiments from any one or more of the following: polymer dispersions, polyolefins, PVA, CMC, starch, PCL, PLA Chitosan, talcum, clay, lattices, $CaCO_3$, NFC, xylane, and hemicellulose.

In an example embodiment, the viscosity of the barrier material is adjusted by use of one or more viscosity modifiers. The viscosity modifiers comprise, for example, any of carboxymethyl cellulose, polyvinyl alcohol or synthetic thickeners.

In an example embodiment, the surface tension of the barrier material is adjusted by use of one or more wetting agents. The wetting agents comprise, for example, any of surfactants.

In an example embodiment, the second side 112*b* is sized or coated for curl control, water control and/or penetration support purpose using any of the known compositions for this purpose.

The nip rolls 230*a*, 230*b* are configured to press the surface treatment material at least partly through the respective surface of the paper web 112 into the structure of the paper web when the paper web 112 travels through the nip.

The barrier material can be heated to a temperature high enough to bind the barrier material onto the paper web so as to avoid subsequent peeling of the barrier material.

In an example embodiment, the nip is temperature controlled e.g. by circulation of temperature control fluid inside one or both nip rolls 230*a*, 230*b* and/or by use of electric heating elements. The temperature control comprises, depending on circumstances and the example embodiment, cooling, heating or as needed cooling or heating. The temperature in the nip can thus be adjusted to a level in which the barrier material adheres to the paper web.

The barrier material can also or alternatively be heated by one or more drying elements.

Adhering to the paper web may refer to forming a sufficiently strong and strongly attached a layer to withstand subsequent processing without peeling off from the paper web. Preferably the temperature of the nip is kept low enough to avoid excessively losing viscosity of the barrier material in order to avoid or mitigate some staining problems. Such problems might otherwise prevent or hinder commercially reasonable online surface treatment of the paper web 112 with the barrier material.

The nip load and nip rolls are configured suitably for the used surface treatment material and for the desired properties of the paper web 112. In this case, the surface treatment is performed such that desired total basis weight is attained, when taking into account any other surface treatment processes performed with the paper machine 100. The desired total basis weight is e.g. 25.5 g/m2 to 34 g/m2 when measured in balance moisture. By measuring in balance moisture reference is made to normal paper testing conditions i.e. 23° C., 50% relative humidity, normal air pressure.

The nip rolls 230*a*, 230*b* may belong to a size press.

In an example embodiment, the barrier material is cooled before applying onto the first side of the paper web in the on-line surface treating. The barrier material is cooled e.g. to a temperature of 15° C. to 25° C. before applying onto the first side of the paper web in the on-line surface treating.

The on-line surface treating is performed in one example embodiment with the barrier material such that the melting point of staining components in the barrier material is sufficiently separated from the temperature in which the barrier material is brought onto the paper web. The temperature separating can be provided by controlling at least one of the composition of the barrier material and the temperature of the barrier material when measured at the moment of applying onto the surface of the paper web.

The paper web 112 is processed in one example embodiment in two surface treatment phases so that two layers of barrier material, i.e. a first layer and a second layer, are sequentially applied on the first side 112*a* of the paper web 112. The barrier material may be let to cure or dry between sequential on-line surface treatment phases such that previously applied barrier material inhibits penetration of water in subsequent applying of barrier material into the base paper web.

The two-phase surface treatment advantageously reduces water load on the paper web 112 and thus reduces momentary impairment of the tensile strength of the paper web. The better the tensile strength, the smaller the risk of paper breaks and of spreading wet or poorly cured or dried surface treatment material onto subsequent drying rolls or other hot parts of the paper machine 100. Moreover, the two-phase surface treatment enables use of barrier materials of different compositions and/or different water content in the different layers.

For example, the first layer can be produced to a greater basis weight than the second layer. The first layer can be produced to a basis weight that is 1 to 3, preferably 2, times the basis weight of the second layer, when in balance moisture. The first layer can be produced to a basis weight of 0.3 $g/m^2$ to 4.5 $g/m^2$ when in balance moisture. The second layer can be produced to a basis weight of 0.3 $g/m^2$ to 3 $g/m^2$ when in balance moisture. The first and second layers can be produced to a combined basis weight of 1 $g/m^2$ to 4.5 $g/m^2$ and preferably 3 $g/m^2$ when in balance moisture.

In an example embodiment, the first layer is formed to contain one or more opacifying chemicals so that desired opacity is attained for the manufactured wrap paper. The opacifying chemicals can be selected e.g. from a group consisting of: $TiO_2$; kaolin; clay; talcum; $CaCO_3$; and any composition comprising any one or more thereof.

Opacifying chemicals need not be added to the barrier material with which the second layer is formed. Concentration of opacifying chemicals in the second layer is thus in one example embodiment less than half or less than tenth of that in the first layer. By omitting opacifying chemicals, the second layer may become less porous than the first layer. Moreover, by containing opacifying chemicals substantially solely in the first layer, total amount of opacifying chemicals may be reduced for a given desired opacity level.

After each surface treatment phase, the paper web 112 can be guided and dried with contactless elements such as one or more blow boxes 250 and/or infrared dryers 260 to an extent that enables contacting processing without excessively disturbing surface treated surface or surfaces of the paper web 112. Alternatively, a sufficiently long free span may be provided to let the paper web 112 cure and/or dry before contacting parts of the paper machine 100. Using contactless support and/or drying elements can yet help to reduce total length of the product line, increase water removal capacity and/or reduce length of free spans and thus reduce web break risks.

In embodiments in which only one side of the paper web 112 is surface treated at a given station by applying sizing or coating material such as the barrier material, the paper web 112 can be supported from the side that is not sized or coated by that station.

It shall be understood that FIG. 2 shows a number of parts that can be omitted and that the in some cases, the proportions of dimensions may differ from practical implementations. For instance, the distance between elements and the sizes of elements in FIG. 2 may greatly vary. For example, there a free travel of one to three meters can be arranged between surface treatment and next and/or previous heated element for avoiding or mitigating the forming of hard to remove stains or depositions. Correspondingly, cold or non-heated paper guiding or processing elements may additionally or alternatively be located between surface treating the paper web 110 and next and/or preceding heated elements.

Various embodiments have been presented. It should be appreciated that in this document, words comprise, include and contain are each used as open-ended expressions with no intended exclusivity.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A method for manufacturing food wrap paper, comprising:

forming a paper web; and on-line with the paper web forming, surface treating a first side of the paper web by applying barrier material so as to inhibit penetration of water vapour, water, grease and oily substances to the paper web;

wherein the forming and on-line surface treating are made so that after the on-line surface treating, the paper web has basis weight of from 25.5 $g/m^2$ to 34 $g/m^2$ when measured in balance moisture, and wherein the on-line surface treating of the first side of the paper web is performed in two or more on-line surface treatment phases comprising a first on-line surface treatment phase of barrier material and a second on-line surface treatment phase of barrier material following the first on-line surface treatment phase.

2. The method of claim 1, wherein the first on-line surface treatment phase of barrier material is made to apply barrier material at a greater basis weight than the second on-line surface treatment phase of barrier material.

3. The method of claim 1, wherein the basis weight of barrier material at the first on-line surface treatment is 1 to 3 times the basis weight of the barrier material at the second on-line surface treatment, when in balance moisture.

4. The method of claim 1, wherein the basis weight of barrier material at the first on-line surface treatment is from 0.3 $g/m^2$ to 4.5 $g/m^2$ when in balance moisture.

5. The method of claim 1 wherein the basis weight of the barrier material at the second on-line surface treatment is from 0.3 $g/m^2$ to 3 $g/m^2$ when in balance moisture.

6. The method of claim 1, wherein the barrier material as a whole has a combined basis weight of from 1 $g/m^2$ to 4.5 $g/m^2$ when in balance moisture.

7. The method of claim 1, wherein the first and/or second on-line treatment phase is/are performed using an on-line surface treatment station selected from a group consisting of: a short-dwell coating or sizing station; an applicator roll coating or sizing station; a curtain coating or sizing station; a spray coating or sizing station; and a film transfer coating or sizing station.

8. The method of claim 1, wherein the first on-line surface treatment phase is separated from heated cylinders by one or more non-heated rolls, air doctors or sufficient free span for avoiding spreading of barrier material onto hot cylinders in order to avoid resulting forming of stains that are hard to remove.

9. The method of claim 1, wherein the paper web is dried between sequential on-line surface treatment phases.

10. The method of claim 9, wherein the paper web is cooled after the drying before the second on-line surface treatment phase.

11. The method of claim 1, wherein the paper web is calendered between sequential on-line surface treatment phases so that the first side of the paper web is smoothened.

12. The method of claim 1, wherein the second on-line surface treatment phase is separated from heated drying cylinders by the on-line calendering for avoiding scattering drops of the barrier material onto hot drying cylinders in order to avoid resulting forming of stains that are hard to remove.

13. The method of claim 1, wherein the base paper is formed substantially without added opacifying chemicals.

14. The method of claim 1, wherein the first side of the paper web is formed to contain one or more opacifying chemicals so that desired opacity is attained for the manufactured wrap paper.

15. The method of claim 14, wherein the opacifying chemicals are applied during both the first on-line surface treatment phase of barrier material and the second on-line surface treatment phase of barrier material, and wherein the concentration of opacifying chemicals applied during the second on-line surface treatment phase is less than half or tenth of that applied during the first on-line surface treatment phase.

16. The method of claim 1, wherein the second side of the paper web, opposite to the first side, is on-line sized or on-line coated.

17. The method of claim 16, wherein the online sizing or coating of the second side is performed for curl control, water control and/or penetration support.

18. The method of claim 16, wherein the second side is sized or coated substantially simultaneously with the on-line surface treating.

19. The method of claim 1, wherein the barrier material is formed using one or more of the following: polymer dispersions, polyolefins, PVA, CMC, starch, PCL, PLA Chitosan, talcum, clay, lattices, $CaCO_3$, NFC, xylane, and hemicellulose.

20. The method of claim 1, wherein the first side of the paper web is machine glazed before the surface treating.

21. The method of claim 1, wherein the on-line surface treating of the first side is performed using an on-line treating nip formed with a pair of nip rolls.

22. The method of claim 21, wherein the nip is temperature controlled and the temperature in the nip is adjusted to a level in which the barrier material adheres to the paper web.

23. The method of claim 1, wherein the on-line surface treating of the first side is performed using an on-line treating nip formed with a pair of nip rolls.

24. The method of claim 23, wherein the nip is temperature controlled and the temperature in the nip is adjusted to a level in which the barrier material adheres to the paper web.

25. The method of claim 1, wherein the on-line surface treating is performed with the barrier material such that the melting point of staining components in the barrier material is sufficiently separated from the temperature in which the barrier material is brought onto the paper web.

26. The method of claim 1, wherein the viscosity of the barrier material is adjusted by use of one or more viscosity modifiers.

27. The method of claim 1, wherein the surface tension of the barrier material is adjusted by use of one or more wetting agents.

28. The method of claim 1, further comprising calendering the food wrap paper to target thickness.

29. The method of claim 28, wherein the target thickness is 33 μm to 35 μm.

30. The method of claim 1, wherein the barrier material is machine glazed before the surface treating.

* * * * *